United States Patent [19]

Lehmann

[11] Patent Number: 4,841,829

[45] Date of Patent: Jun. 27, 1989

[54] DEVICE FOR SUPPORTING THE WEIGHT OF A CLARINET

[76] Inventor: Walter J. Lehmann, P.O. Box 35, Lebanon Springs, N.Y. 12114

[21] Appl. No.: 134,253

[22] Filed: Dec. 17, 1987

[51] Int. Cl.[4] ..... G10G 5/00

[52] U.S. Cl. ..... 84/385 A; 84/453; 224/910

[58] Field of Search ..... 84/327, 385 A, 387 A, 84/453; 224/219–221, 910

[56] References Cited

U.S. PATENT DOCUMENTS 4,728,123 3/1988 Kassal et al. ..... 224/220

FOREIGN PATENT DOCUMENTS 957345 11/1974 Canada ..... 224/910

2141282 12/1984 United Kingdom ..... 84/327

*Primary Examiner*—Lawrence R. Franklin

*Attorney, Agent, or Firm*—Joseph R. Carvalko, Jr.

[57] ABSTRACT

A device worn on a musician's wrist used in combination with a fastening means on the lower end of a clarinet for supporting the weight of the clarinet and thus relieving the strain on the musician's thumb and hand muscles. The device is to be worn about the wrist and thumb and attached to an instrument comprising an elongate flexible means having an attachment means at one end and a wrist band at the opposite end. There is a means to secure the flexible means to a lower end of the instrument. The device includes a wrist band that is circumferentially disposed about a wrist joint over the area of the wrist's transverse carpal bones and ligaments. The wrist band has an attached strap which extends over the webbed portion of the space between the thumb and the index finger which courses downward upon leaving the webbed area, finally attaching to a clarinet lift point on the bell end of the clarinet.

6 Claims, 2 Drawing Sheets

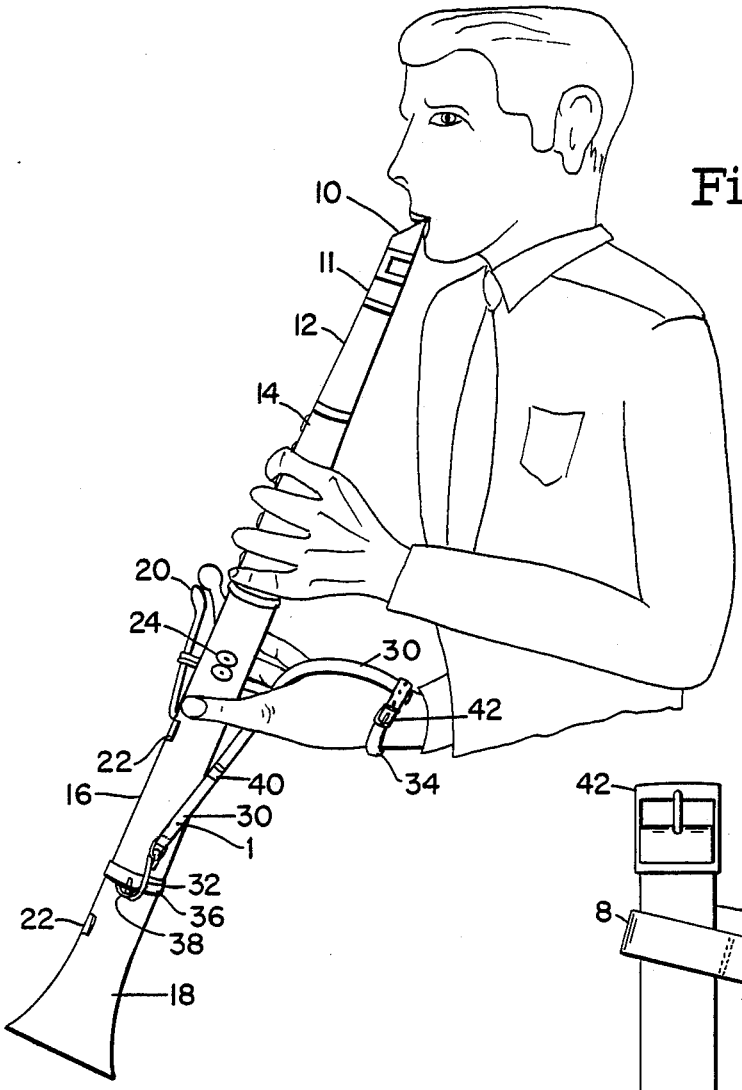
Fig.1
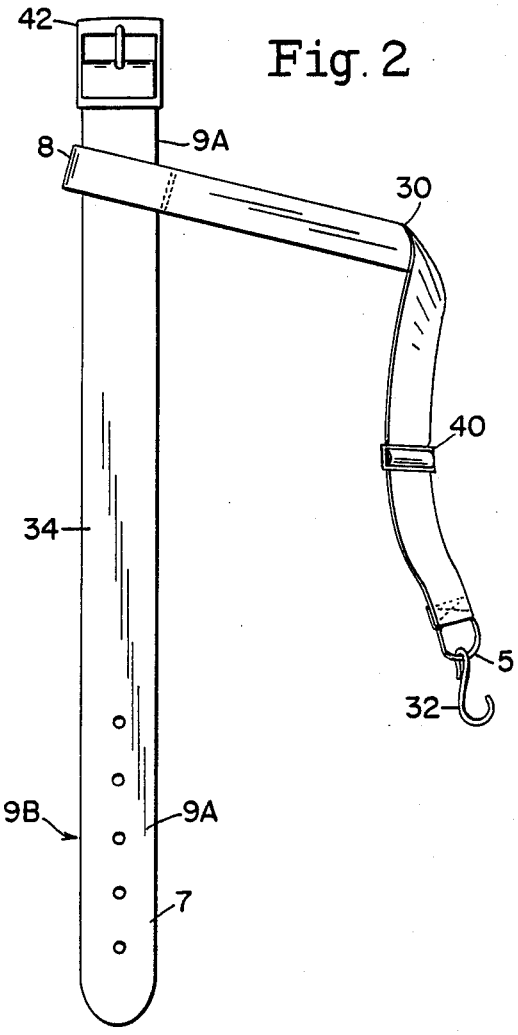
Fig. 2
Fig. 3
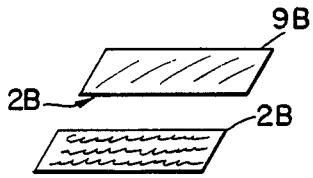

DEVICE FOR SUPPORTING THE WEIGHT OF A CLARINET

BACKGROUND OF THE DISCLOSURE

1. Field of the Invention

This invention relates to a novel clarinet support for attachment to a conventional clarinet and the user's wrist such that support for the weight of the instrument is transferred from the thumb to the fleshy part of the upper hand and wrist area.

2. Description of the Prior Art

The conventional B-flat clarinet includes the major components of a mouthpiece, a barrel, an upper joint with keys, a lower joint with keys and a bell, where the sound emanates from. The lower joint usually includes a thumb rest. The thumb rest, rests on the thumb and is the usual manner in which the weight of the clarinet is supported and which ultimately affects one's ability to play relaxed.

A difficulty experienced by clarinet musicians is that over an extended playing interval, the thumb bears a major part of the clarinet's weight. When the thumb muscles tire it becomes increasingly difficult to either hold the instrument in its correct position or not to experience fatigue in other hand muscles, which ultimately affects one's ability to play well.

The problem of ensuring that the clarinet is correctly held was thoroughly discussed by Schmidt in U.S. Pat. No. 3,192,816. The Schmidt device was comprised of a stiff member or beam which when attached to the clarinet at its mid-section was used to brace the clarinet against the chest of the musician. Although the Schmidt invention may have transferred some the weight of the clarinet to the beam it did not adequately address the primary forces which are downward along a line generally parallel to the musicians body. Furthermore, the main object served by U.S. Pat. No. 3,192,817 was positioning and not weight transfer.

SUMMARY OF THE PRESENT INVENTION

The present invention relates to a support device which is worn about the wrist and wrapped through the webbed space between the thumb and index finger, finally attaching to an oblong wind instrument. The device herein described in generally an elongate flexible means, such as a narrow swath or strap of fabric, having a means for attaching the instrument to one end of the swath or strap and a means for attaching to the user's wrist at the opposite end. More particularly the support device includes a fabric wrist hand which is circumferentially worn on the wrist and tightened using either a standard buckle or a self-binding material. The wrist band covers the wrist over the area of the carpal bones and ligaments immediately distal to the prominence of the distal radius and ulna, the two major long bones which make up the forearm.

The wrist band serves as an anchor for the fabric strap which extends at a right angle from the wrist band and generally follows a line colinear with the radius bone of the forearm and curving downwardly coming in contact with the middle of the web of the thumb and index finger. Forward to the web of the thumb and index finger the fabric strap runs a downward course in the direction of its terminal lift point at the lower joint of the clarinet. At the end of the fabric strap is a hook which is attached to a clamp or lift point on the clarinet. The clamp consists of a ring which is fit snugly around the lower joint of the clarinet. On the clamp is an appendage that accepts the hook, thus suspending the clarinet when in use.

The device supports the clarinet by transferring its weight from the thumb rest and the relatively narrow radial side of the thumb distal phalanx to the broader webbed space whcih is padded by the adductor pollicis and first dorsal interosseous muscle. The effect is to simply transfer and distribute the weight of the clarinet over a greater surface area thus reducing pressure on the anatomy of the thumb and hand.

The device provides support through a broad flexible area of the hand and wrist. When the thumb rest and thumb is used to support the weight of the clarinet the effective lever is the distance as measured from the thumb-clarinet contact point to the wrist extensor and flexor muscles. By comparing the conventional method of supporting the clarinet with the present invention it can be shown that the mechanical advantage of the wrist musculature using the present invention is enhanced. In the conventional manner of holding a clarinet, the lever arm, with a fulcrum at the thumb, acts through a distance from the thumb to the wrist. By moving the weight to a point on the wrist band the wrist extensor and flexor muscles no longer must be used in transferring the weight of the clarinet from the thumb to the forearm. The fulcrum of the lever in the present invention is now a pivot point at the wrist.

It is therefore a broad object of the present invention to provide a support device to be worn on a users hand that when attached to a clarinet provides support for the weight or the clarinet when playing.

It is a further object of the present invention to provide a novel means to assist the musician in holding the clarinet relieving the musician's thumb from stress by shifting to a more suitable part of the anatomy to bear the weight of the clarinet.

The foregoing objects and others are accomplished in accordance with the present invention by providing a device to be worn about the wrist and wrapped over the thumb and index finger web, and attaching finally to an oblong wind instrument, such as a clarinet.

BRIEF DESCRIPTION OF THE DRAWING

For a better understanding of the present invention as well as other objects and features herein disclosed, reference is made to the following detailed disclosure of this invention taken in conjunction with the accompanying drawings herein:

FIG. 1 is a partial perspective view of a musician using the support device to support the weight of the clarinet;

FIG. 2 is a perspective view of the preferred embodiment of a support device in accordance with the present invention;

FIG. 3 is a partial perspective view of an alternate embodiment of a means for fastening the wrist band to the wrist;

DESCRIPTION OF THE PREFERRED EMBODIMENTS

Figure 4:
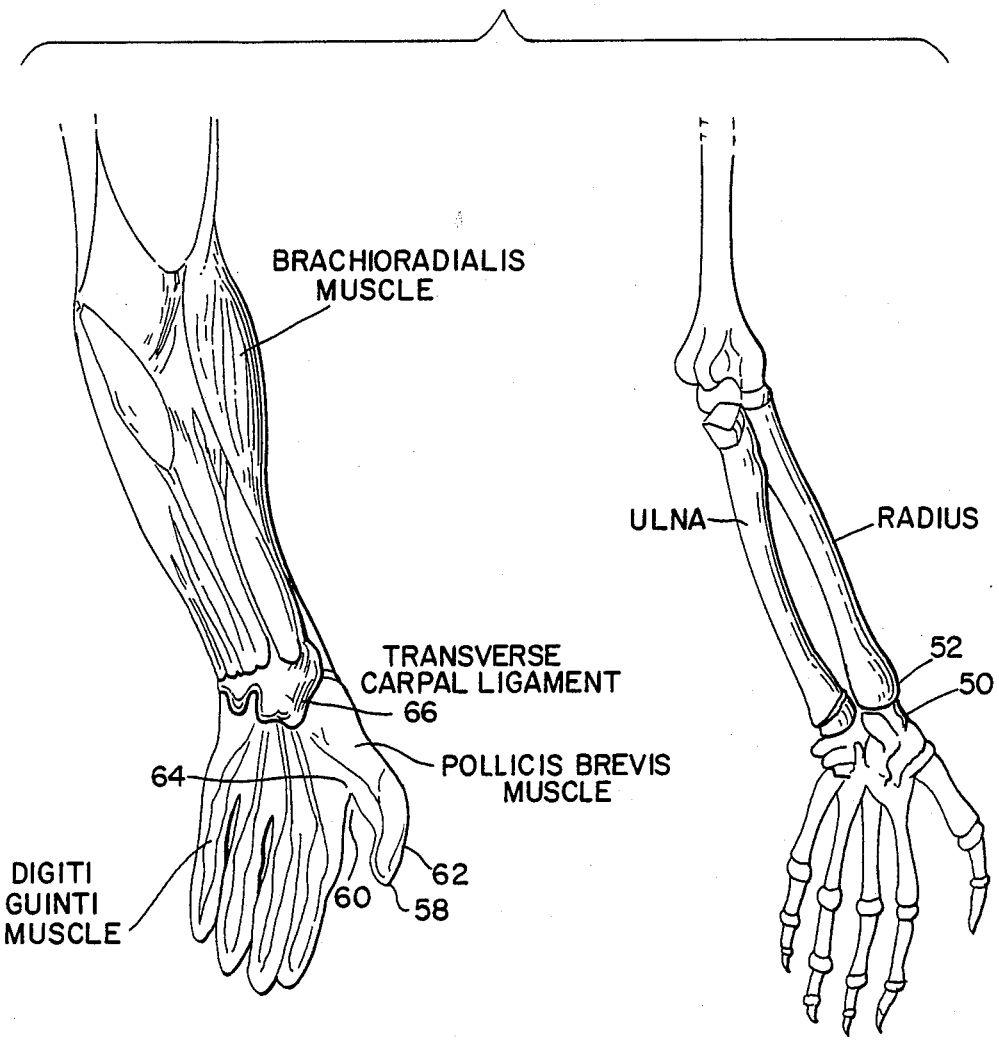
FIG. 4 is a partial perspective view of the anatomy of important muscles, ligaments and skeletal components that interact with the present invention.

Referring to FIG. 1 there is shown a musician supporting a clarinet 11 and utlizing the support device 1 in accordance with the features of the present invention.

The clarinet 11 is played by blowing into a mouthpiece 10. There is a upper joint 12 which is fitted to an upper central portion 14 which fits into a lower joint 16. A lower joint 16 has a flared end or bell end 18 from which the sound emanates.

The support 1 is secured to the bell end 18 of the clarinet 11 by employing a ring 36 having a looped appendage 38 such that a hook 32 engages the support 1 when the clarinet 11 is being used and disengaged when the clarinet 11 is not being used.

There is illustrated in FIG. 2 the device 1 in accordance with the present invention. There is a flexible fabric wrist strap 34 which is worn about the wrist and a support 30 attached at approximately a right angle thereto. The support strap 30 is permanently fastened on the wrist band at 8.

The fabric preferred is that of a flexible and relatively pliable material such as a cloth although other kinds of materials such as plastics or leathers are not precluded. The wrist strap 34 is separable and secured by a buckle 42 and perforations 7 or strap holes.

FIG. 3 illustrates an alternate embodiment to the buckle 42, a separable fastener sold under trademark "Velcro" comprising a patch of loop pile fabric 2A can be secured to the top part 9A or strap portion 34 in place of the buckle 42; and a patch of hook type fabric 2B secured to the bottom part 9B of the strap portion 34 in place of the perforations 7. The two surfaces of hook type fabric will interlock on contact.

There is shown in FIG. 2 an adjustment means 40 that will allow the user to lengthen or shorten the distance between the wrist and the bell end of the clarinet. The strap 30 length has been found to be optimum when the thumb can be positioned on the clarinet lower joint approximately one-quarter of an inch under the thumb rest 24.

The support strap 30 is made of a fabric having sufficient strength to support the weight of the clarinet. The width of strap 30 is not critical but must be narrow enough to fit into the web between the thumb and index finger. Further it should be comfortable.

The wrist band 34 has a width that substantially covers the width of the wrist. Depending on the individual it is generally the distance between the distal radius and the carpal bones. This width is not critical and the inventor has employed a two centimeter wide fabric with success. If the band is too wide it interferes with the ability to freely move the wrist. If the width is too narrow it applies unnecessary pressure to the epidermis.

FIG. 4 illustrates the essential aspects of the anatomy involved in substituting the support device for the thumb rest as a primary means to support the weight of the clarinet 11.

With reference to FIG. 2 and FIG. 4 the wrist band 34 circumferentially fastens around the wrist over the carpal bones 50 and carpal ligaments 66 serves as the primary anchor point for supporting and balancing the clarinet. The strap 30 courses downward over the adductor pollicis muscle through the first web space 60. The device provides support through a broad flexible area of the hand and wrist rather than the distal thumb 62.

By transferring the anchor point from the distal phalanx 62 to the wrist, the strain on the anatomy involving the thumb and musculature between the thumb and wrist is reduced. By employing the present invention the force of the weight of the clarinet is transferred and bears on the wrist and not the thumb.

While this invention has been described in conjunction with particular embodiments, it is evident that alternatives, modifications and variations will now be apparent to those skilled in the art. Accordingly, the present invention is intended to embrace all such alternatives, modifications and variations and fall within the spirit and scope of the appended claims.

What is claimed is:

1. A device to be worn about the wrist and thumb and attached to a wind instrument for support thereof comprising;

A. a flexible and pliable strap such as cloth, substantially 2 centimeters in with, having a hook at one end and permanently fastened to a wrist band at the opposite end;

B. a clamp fastened at the instruments lower end, having a looped appendage;

C. said hook attached to the looped appendage;

D. whereby when said wrist band is attached to the wrist and said strap wrapped over the thumb and index finger web, the instrument is thus supported.

2. A device to be worn about the wrist and thumb and attached to a wind instrument for support thereof comprising:

A. a flexible and pliable strap, such as cloth, substantially 2 centimeters in width, having a hook at one end and permanently fastened to a wrist band at the opposite end;

B. a clamp fastened at the instrument's lower end;

C. said hook attached to said clamp;

D. whereby when said wrist band is attached to the wrist and said strap wrapped over the thumb and index finger web, the instrument is thus supported.

3. A device to be worn about the wrist and thumb and attached to a wind instrument comprising:

A. an elongate flexible and pliable means, such as cloth, substantially 2 centimeters in width, having an attachment means at one end and permanently fastened to a wrist band at the opposite end;

B. a means to secure the flexible means to a lower end of the instrument;

C. whereby when said wrist band is attached to the wrist and said elongate flexible means is wrapped over the thumb and index finger web, the instrument is thus supported.

4. The device as claimed in 3 whereby the elongate flexible means is adjustable.

5. The device as claimed in 3 whereby the elongate flexible means is made of leather.

6. The device as claimed in 3 whereby the elongate flexible means is made of plastic.

* * * * *